United States Patent [19]

Tojo

[11] Patent Number: 4,944,706

[45] Date of Patent: Jul. 31, 1990

[54] CATHODE RAY TUBE AND METHOD OF MAKING THE SAME

[75] Inventor: Toshio Tojo, Chiba, Japan

[73] Assignees: Hitachi, Ltd., Tokyo; Hitachi Device Engineering Co., Ltd., Chiba, both of Japan

[21] Appl. No.: 378,501

[22] Filed: Jul. 11, 1989

Related U.S. Application Data

[63] Continuation of Ser. No. 155,061, Feb. 11, 1988, abandoned.

[30] Foreign Application Priority Data

Mar. 20, 1987 [JP] Japan ..... 62-63862

[51] Int. Cl.[5] ..... H01J 9/00

[52] U.S. Cl. ..... 445/8; 358/246

[58] Field of Search ..... 445/8; 313/479; 358/246

[56] References Cited

U.S. PATENT DOCUMENTS

| | | | |
|---|---|---|---|
| 3,220,593 | 11/1965 | Powell | 358/246 |
| 3,512,234 | 5/1970 | Bongenaar | 445/8 |
| 4,031,553 | 6/1977 | Sumiyoshi | 358/246 |
| 4,155,102 | 5/1979 | Bongenaar | 358/246 |
| 4,432,018 | 2/1984 | Futatsudera | 358/246 |
| 4,563,612 | 1/1986 | Deal et al. . | |

FOREIGN PATENT DOCUMENTS

| | | | |
|---|---|---|---|
| 2240735 | 2/1973 | Fed. Rep. of Germany | 358/246 |
| 0006076 | 1/1977 | Japan | 445/8 |
| 0121740 | 7/1984 | Japan | 445/8 |
| 1513809 | 6/1978 | United Kingdom . | |

OTHER PUBLICATIONS

Partial European Search Report EP No. 88301204.9.

Patent Abstracts of Japan—vol. 10, No. 306; vol. 11, No. 220; and vol. 7, No. 80.

*Primary Examiner*—Kurt Rowan

*Attorney, Agent, or Firm*—Antonelli, Terry, Stout & Kraus

[57] ABSTRACT

A cathode ray tube subjected to an antistatic treatment and a method of making the same. A conductive surface of a panel of a bulb body is grounded through a metal reinforcement serving as a reinforcement for maintaining the bulb's inward bursting resisting properties to instantaneously leaking any electrified charge, thereby providing the antistatic cathode ray tube which is free from the effect of air-conditioned humidities. Thus, there is the effect of preventing the occurrence of erroneous operations of the cathode ray tube and peripheral units and adverse effects on the human body, e.g., electric shock due to the charged static electricity on the panel surface, and there is another effect that the implosion protective adhesive glass tape or the member interposed between the conductive coating and the metal reinforcement is equivalent to lead wires thus eliminating the use of lead wires and thereby eliminating the provisions of complicated connections to the panel surface.

6 Claims, 4 Drawing Sheets

HUMIDITY : 50 % RH

CATHODE RAY TUBE AND METHOD OF MAKING THE SAME

This application is a continuation, Ser. No. 155,061, filed Feb. 11, 1988, now abandoned.

BACKGROUND OF THE INVENTION

The present invention relates to a cathode ray tube subjected to an antistatic treatment and a method of making the same, and more particularly the invention relates to a cathode ray tube so designed that the electrified charge on the surface of a panel is leaked to a set chassis by means of a metal reinforcement, thereby preventing erroneous operations of the cathode ray tube and peripheral units and ill effect on the human body due to static electricity.

As a conventional antistatic treatment for cathode ray tubes, there has been proposed a method of making the surface of a panel of a cathode ray tube conductive as disclosed in JP-A-62-37850, and the desired antistatic effect has in fact been obtained by selecting the surface specific resistance of the panel less than $1\times10^{11}\Omega$ when the operating environment of the cathode ray tube has a humidity of less than 40–60% RH (Relative Humidity).

The technique disclosed in this prior art publication is such that in the cathode ray tube subjected to a non-glare treatment by forming a finely rugged and impressed surface layer on the outer surface of the face panel at the front of the glass bulb of the cathode ray tube, a thin silica film is additionally formed on the rugged and impressed surface layer thereby not only maintaining the desired non-glare effect but also enhancing the resolution and ensuring an excellent antistatic effect and electric shock preventing properties.

On the other hand, a technique of applying lithium silicate and forming a rugged and impressed coating on the surface of a cathode ray tube to ensure the desired reflection reducing effect and antistatic effect has been disclosed in a literature entitled "Lithium Silicate Antiglare Faceplate System For RCA Color Data Display Tubes", RCA, June, 1986, U.S.A. However, both of these prior art techniques have not gone to refer in detail to the grounding of the panel surface. When an insulation is provided between the panel surface and the metal reinforcement, that is, when the panel surface is not grounded, the surface specific resistance must be reduced to less than $1\times10^{10}\Omega$ in cases where the air-conditioned humidity is less than 40% RH during the operation of the cathode ray tube. There is another disadvantage that where the humidity is less than 20% RH, no great antistatic effect can be obtained even if the surface specific resistance is selected less than $1\times10^{7}\ \Omega$.

Also, there has been disclosed in JP-A-62-43042 a technique by which a front panel is applied to the surface of a face panel of a cathode ray tube by means of a transparent conductive adhesive resin prepared by mixing finely powdered silver, copper, carbon or the like into polyester resin and lead wires are brought out from the adhesive resin, thereby maintaining the front panel as well as the fastening metal members and the external conductive coating at the ground potential to prevent the face panel surface from being charged with static electricity. In other words, the adhesive resin is made conductive and the lead wires are connected to the adhesive resin, thereby ensuring the desired grounding.

In addition, JP-A-62-43043 has disclosed a technique by which a front panel composed of a conductive glass containing vanadium, etc., and having an electrical resistance of less than about $10^3$–$10^9$ Ωcm is applied to the surface of a face panel of a cathode ray tube with an adhesive resin and lead wires are brought out from the front panel, thus maintaining the front panel as well as the fastening metal members and the external conductive coating at the grounding potential and thereby preventing the face panel surface from being charged with static electricity. In other words, the front panel is made conductive and the lead wires are connected to the front panel, thereby ensuring the desired grounding.

With the methods disclosed in the abovementioned JP-A-62-43042 and JP-A-62-43043, however, the lead wires are connected through the terminals so that the areas of the connection portions are small and conduction failure tends to occur, thus making it difficult to connect the lead wires to the conductive member. Moreover, there is a disadvantage that even if the lead wires are connected, conduction failure tends to occur at these portions.

SUMMARY OF THE INVENTION

It is a primary object of the present invention to provide an antistatic cathode ray tube so designed that the conductive surface of a panel is grounded through a metal reinforcement band or a reinforcing member for maintaining the inward bursting resistance of a bulb so as to instantaneously leak any electrified charge and to liminate the effect of the air-conditioned humidity and a method of making such cathode ray tube.

It is another object of the invention to provide such a cathode ray tube so designed that the air-conditioned humidity has practically no effect on the tube during its operation and also a satisfactory antistatic effect is ensured even in low humidity conditions.

To accomplish the above objects, in accordance with the invention there is provided a cathode ray tube in which conductivity is imparted to an insulating member (hereinafter referred to as an implosion protective adhesive glass tape) which insulates the conductive surface of a panel from a metal reinforcement, thereby grounding the conductive surface of the panel to a set chassis through the adhesive glass tape and the metal reinforcement. The conductivity of the adhesive glass tape is provided by a particulate conductive material for example by impregnating the tape with 0.1 to 10 ml per 12-inch cathode ray tube of a solution prepared by dissolving or colloidally suspending 0.2 to 10% by weight of salts or oxides of such metal as tin (Sn), indium (In) or aluminum (Al) and non-metallic material such as silicon (Si) in water and alcohol or other organic solvent and drying the adhesive glass tape.

In accordance with the invention, by providing the implosion protective adhesive glass tape with the desired conductivity, it is possible to ground the conductive surface of the panel to the set chassis through the adhesive glass tape and the metal reinforcement. This has the effect of instantaneously leaking the electrified charge on the surface of the panel to the set chassis irrespective of the air-conditioned humidity, thereby preventing any erroneous operations of the cathode ray tube and the peripheral units and any ill effect on the human body, e.g., electric shock due to the electrification of the panel surface with static electricity.

Further, in accordance with the invention the implosion protective adhesive glass tape or the member interposed between the conductive coating and the metal reinforcement is equivalent to the lead wires, thus eliminating the lead wires which have heretofore been necessary. This has the effect of eliminating the complicated connections between the panel surface and the lead wires.

DESCRIPTION OF THE PREFERRED EMBODIMENTS

Figure 1A:
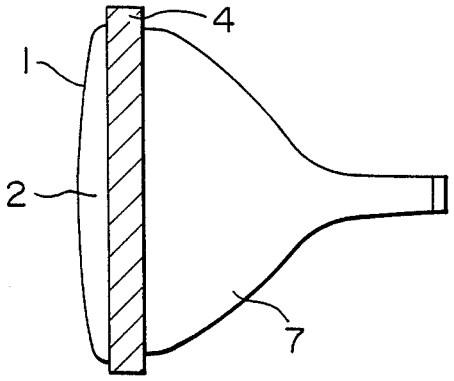
FIG. 1A is a side view of a first embodiment of a cathode ray tube according to the present invention.
Figure 1B:
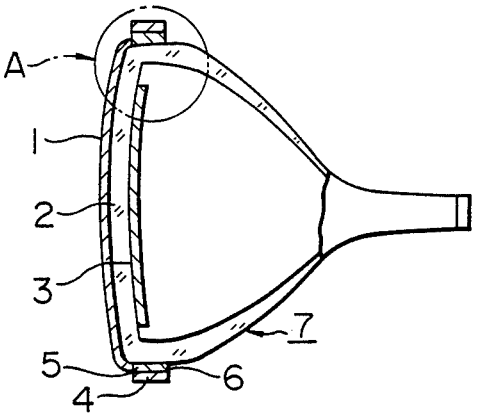
FIG. 1B is a schematic sectional view of Fig. 1A.
Figure 2:
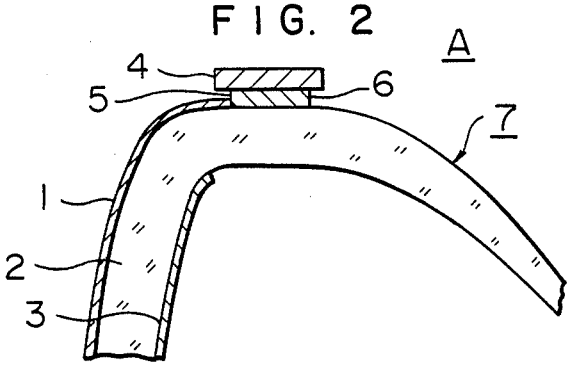
FIG. 2 is a partial detailed view of Fig. 1B.

A first embodiment of the present invention will now be described with reference to Figs. 1A and 1B and FIG. 2. Fig. 1A is a side view of the first embodiment of the invention and Fig. 1B is a schematic sectional view of Fig. 1A. FIG. 2 is a detailed view of the portion of Fig. 1B within a circle A. Note that a metal-backed coating, a shadow mask and etc., are not shown. In the Figures, numeral 1 designates a conductive coating, 2 a glass panel, 3 a fluorescent screen, 4 a metal reinforcement, 5 an implosion protective adhesive glass tape, and 6 a particulate conductive material impregnated into the implosion protective adhesive glass tape 5. Numeral 7 designates a bulb body.

A method of making the above-mentioned cathode ray tube according to the invention will now be described.

First step:

The method will be described by taking the case of a 12-inch color cathode ray tube. After a bulb body 7 has been produced, an implosion protective adhesive glass tape 5 and a metal reinforcement 4 are fastened around it and a solution containing tin dioxide, $SnO_2$, 1 wt%; ethyl silicate, $Si(OC_{2H5})_4$, 9 wt%; nitric acid, $HNO_3$, 1 wt%; water, $H_2O$, 10 wt%; and ethanol, $C_2H_5OH$, 79 wt% is applied to the outer surface of a glass panel 2 to a thickness of 3000Å by a spray coating method.

In this case, as will be seen from Fig. 1B, the area coverage of the applied solution extends from the front face of the glass panel 2 to the implosion protective adhesive glass tape 5.

Second step:

Then, to prevent the metal reinforcement 4 from rusting, a solution having the same composition as the previously mentioned solution except the elimination of nitric acid used as a catalyst is impregnated into the implosion protective adhesive glass tape 5 in an amount corresponding to about 0.5 ml per glass tape. This is effected after the implosion protective adhesive glass tape 5 has been fastened around the bulb body 7.

Third step:

Then, the whole surface of the cathode ray tube is dried by heating it at 100° C. to 200° C. for about 1 hour, thereby forming a conductive coating 1. The conductive coating 1 is formed to extend from the surface of the glass panel 2 to the implosion protective adhesive glass tape 5 and also a particulate conductive material 6 is incorporated in the implosion protective adhesive glass tape 5, thereby imparting conductivity to the implosion protective adhesive glass tape 5.

With the cathode ray tube constructed as mentioned above, the surface specific resistances of the conductive coating 1 and the implosion protective adhesive glass tape 5 are in the range from $1\times10^9$ to $1\times10^{11}\Omega$. The following Table 1 shows the variations in antistatic effect due to the presence and absence of conductivity in the implosion protective adhesive glass tape 5 in terms of the attenuation rate of the charged voltage on the cathode ray tube panel surface (the time required for the charged voltage on the panel surface to decrease to less than 2 kV after the switch has been turned on and then off with the applied voltage of 23 kV).

Table 1 Antistatic Effects Due to Conductivity of Implosion Protective Adhesive Glass Tape

TABLE 1

Antistatic Effects Due to Conductivity of Implosion Protective Adhesive Glass Tape

| Conductivity of adhesive glass tape | Air-conditioned humidity | |
|---|---|---|
| | 50% RH | 20% RH |
| Present | 5 seconds | 7 seconds |
| Absent | 5 seconds | 40 seconds |

Figure 3A:
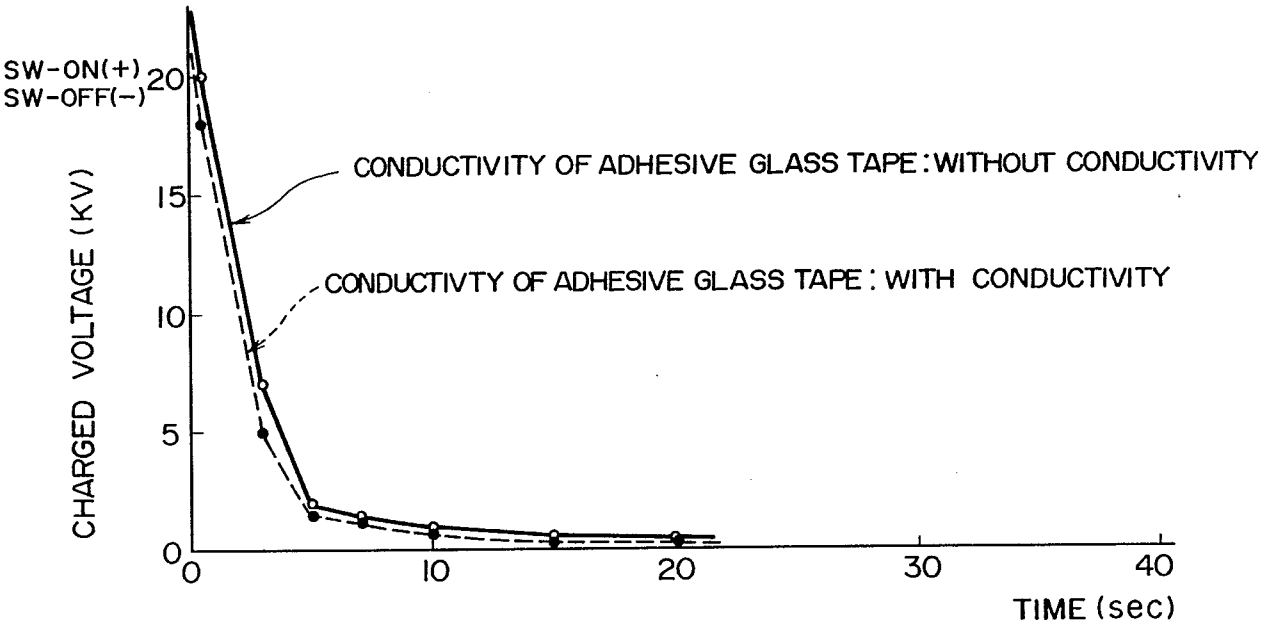
FIGS. 3A and 3B are graphs respectively showing the antistatic effects according to the invention.
Figure 3B:
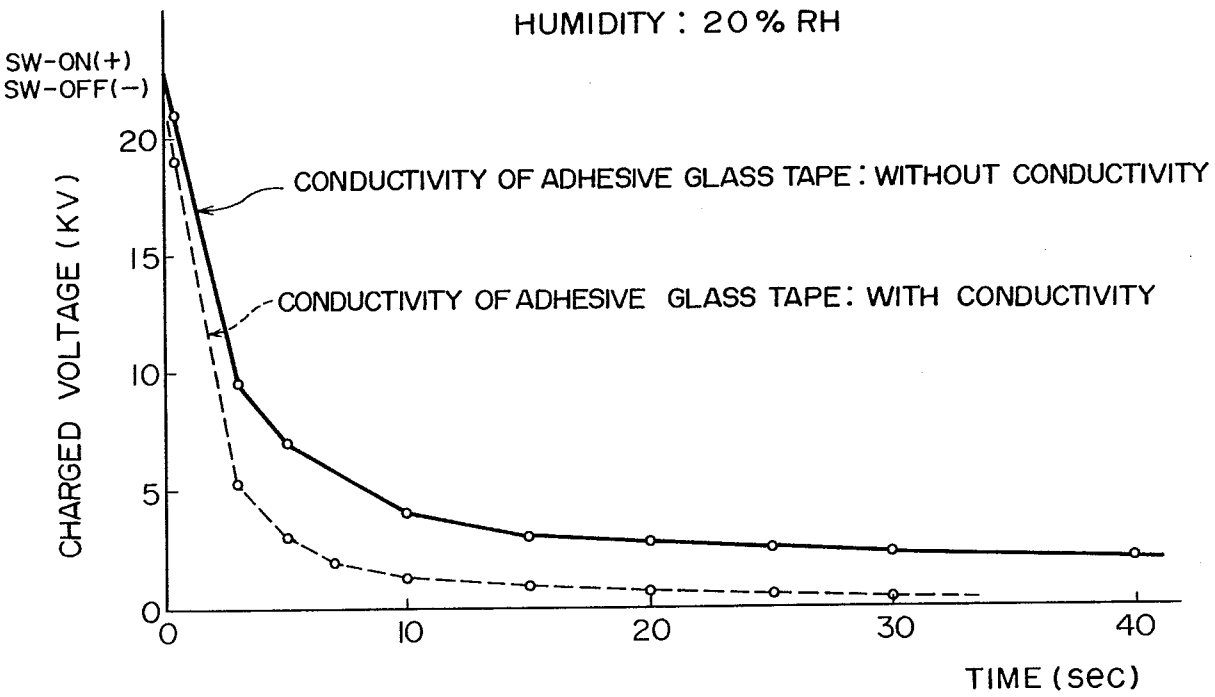

FIGS. 3A and 3B are graphs respectively showing the antistatic effects due to the presence and absence of the conductivity in the implosion protective adhesive glass tapes in the cases where the air-conditioned humidities are 50% RH and 20% RH, respectively, as shown in Table 1.

Thus, as will be seen from Table 1 and the graphs shown in FIGS. 3A and 3B, the desired antistatic effect can be obtained even at low humidities by imparting conductivity to the implosion protective adhesive glass tape 5.

While the above embodiment has been described as applied to a color cathode ray tube, it is needless to say that the invention is not limited thereto. Also, while the prestressed banded structure has been described as an example of the reinforcement as shown in FIGS. 1A and 1B, any other reinforcement such as the P-0-P (Panoply) reinforcement may of course be employed.

Figure 4:
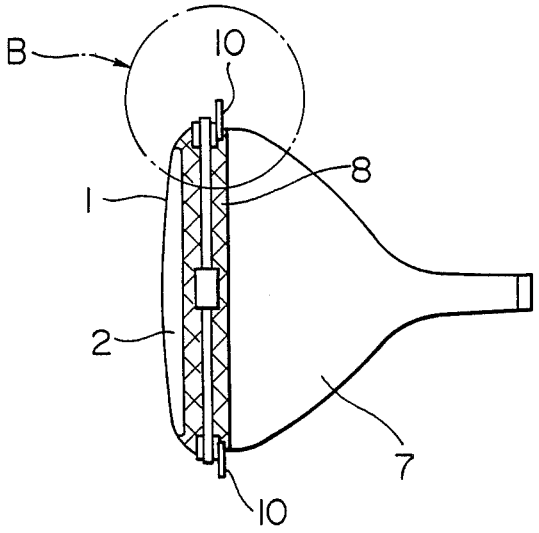
FIG. 4 is a side view of a second embodiment of the cathode ray tube according to the invention.
Figure 5:
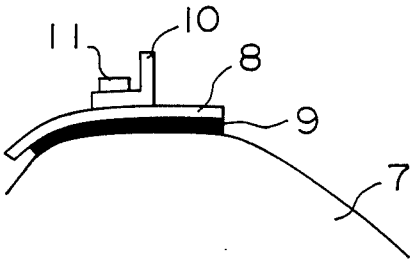
FIG. 5 is a partial schematic sectional view of FIG. 4.

FIG. 4 shows a second embodiment of the invention, and FIG. 5 is a detailed view of the portion of FIG. 4 which is encircled by a circle B. In the Figure, a P-0-P (Panoply) reinforcement 8 is used in place of the metal reinforcement 4. In this case, the P-0-P reinforcement 8 is connected to a bulb body 7 through a resin 9 and then the P-0-P reinforcement 8 and a fitting lug 10 are fastened to the bulb body 7 by a tension band 11. Also, it is self-evident that various kinds of conductive coatings, conductive material compositions, coating thicknesses, impregnation quantities, etc., may be used and the insulating material for imparting conductivity is not limited to the implosion protective adhesive glass tape, that is, a fabric tape and resin may be applied.

From the foregoing description it will be seen that in accordance with the invention the conductive surface of the panel of the cathode ray tube is grounded to the set chassis through the implosion protective adhesive glass tape and the metal reinforcement, thus making it possible to instantaneously leak any stored charge on the panel surface. Moreover, the cathode ray tube is not practically subjected to the effect of the air-conditioned humidity during its operation and the desired antistatic effect can be ensured even at low humidities.

Further, in accordance with the invention the implosion protective adhesive glass tape or the member interposed between the conductive coating and the metal reinforcement is equivalent to lead wires and therefore there is no need to use any lead wires. This has the effect of eliminating the provision of any complicated connections to the panel surface.

I claim:

1. A cathode ray tube comprising:

a bulb body;

a fluorescent screen formed on an inner surface of a panel of said bulb body;

a conductive coating formed on a surface of said panel which is opposite to and substantially parallel to said fluorescent screen;

a metal reinforcement arranged on a front-side wall portion of said bulb body;

an insulating member arranged between said metal reinforcement and said bulb body; and a conductive material impregnated into said insulating material to establish conduction between said metal reinforcement and said conductive coating.

2. A cathode ray tube according to claim 1, wherein said metal reinforcement is of a prestressed banded implosion protection structure.

3. A cathode ray tube according to claim 1, wherein said metal reinforcement is of a P-0-P implosion protection structure.

4. A method of producing a cathode ray tube subjected to an antistatic treatment comprising the steps of:

fastening an implosion protective adhesive glass tape and a metal reinforcement around a bulb body;

coating an outer surface of a glass panel with a solution containing 1 weight % of tin dioxide, 9 weight % of ethyl silicate, 1 weight % of nitric acid, 10 weight of water and 79 weight % of ethanol by a spray coating method;

impregnating into said implosion protective adhesive glass tape a solution having the same composition as said first-mentioned solution except the elimination of said nitric acid; and drying the whole surface of said bulb body by heating the same at 100° C.–200° C. for 1 hour, whereby a conductive coating is formed to extend from the surface of said glass panel to said implosion protective adhesive glass tape, and a conductive material is incorporated into said implosion adhesive glass tape, thereby imparting conductivity to said implosion protective adhesive glass tape.

5. A cathode ray tube comprising:

a bulb body;

a conductive coating formed on a surface of a panel of said bulb body;

a metal reinforcement arranged on a front-side wall portion of said bulb body;

an insulating member arranged between said metal reinforcement and said bulb body; and a particulate conductive material impregnated into said insulating member to establish conduction between said metal reinforcement and said conductive coating, wherein the particulate conductive material is a solution that is impregnated into said insulating member.

6. A cathode ray tube comprising:

a bulb body;

a conductive coating formed on an outer surface of a panel of said bulb body;

a metal reinforcement arranged on a front-side wall portion of said bulb body; and means for physically spacing said metal reinforcement from said body and for establishing an electrically conducting path between said metal reinforcement and said conductive coating comprising an insulating member having an electrically conductive solution impregnated therein.

* * * * *